US008578643B2

(12) United States Patent
Hasler

(10) Patent No.: US 8,578,643 B2
(45) Date of Patent: Nov. 12, 2013

(54) MECHANISM FOR BEDDING A RECEIVER FRAME AND/OR A BARREL IN A STOCK OF A FIREARM

(75) Inventor: Florian Hasler, Wangen (DE)

(73) Assignee: Blaser Finanzholding GmbH, Isny (DE)

( * ) Notice: Subject to any disclaimer, the term of this patent is extended or adjusted under 35 U.S.C. 154(b) by 35 days.

(21) Appl. No.: 13/370,686

(22) Filed: Feb. 10, 2012

(65) Prior Publication Data

US 2012/0204465 A1 Aug. 16, 2012

(30) Foreign Application Priority Data

Feb. 11, 2011 (DE) ..... 10 2011 010 940

(51) Int. Cl.
*F41A 21/00* (2006.01)

(52) U.S. Cl.
USPC ..... 42/75.03; 42/75.01

(58) Field of Classification Search
USPC ..... 42/75.01–75.04, 75.1
See application file for complete search history.

(56) References Cited

U.S. PATENT DOCUMENTS

| | | | | | |
|---|---|---|---|---|---|
| 1,065,341 | A * | 6/1913 | Browning | 42/75.02 |
| 2,145,054 | A * | 1/1939 | Mossberg | 42/75.01 |
| 2,717,465 | A * | 9/1955 | Clark, Jr. et al. | 42/75.01 |
| 2,736,119 | A * | 2/1956 | Clarkson et al. | 42/75.02 |
| 2,765,563 | A * | 10/1956 | Roper et al. | 42/75.03 |
| 2,867,931 | A * | 1/1959 | Schreiber | 42/75.01 |
| 3,731,418 | A * | 5/1973 | Birkenhagen et al. | 42/75.02 |
| 3,842,527 | A * | 10/1974 | Low | 42/75.02 |
| 3,939,589 | A * | 2/1976 | Tellie | 42/71.01 |
| 3,972,143 | A * | 8/1976 | Wild | 42/75.01 |
| 4,385,464 | A * | 5/1983 | Casull | 42/75.03 |
| 4,397,111 | A * | 8/1983 | Morini | 42/73 |
| 4,729,186 | A * | 3/1988 | Rieger | 42/75.04 |
| 5,540,008 | A | 7/1996 | Kirnstätter | |
| 5,813,158 | A * | 9/1998 | Campbell et al. | 42/75.03 |
| 6,212,814 | B1 * | 4/2001 | Lambie | 42/75.03 |
| 6,301,817 | B1 * | 10/2001 | Hogue et al. | 42/71.01 |
| 6,487,805 | B1 * | 12/2002 | Reynolds | 42/75.03 |
| 6,889,463 | B2 * | 5/2005 | Orth | 42/75.03 |
| 7,104,000 | B2 * | 9/2006 | Orth | 42/71.01 |
| 7,587,853 | B2 * | 9/2009 | Aalto | 42/76.01 |
| 7,685,757 | B2 * | 3/2010 | Rohrauer | 42/75.01 |
| 7,823,314 | B1 * | 11/2010 | Wheatley | 42/75.02 |
| 7,886,473 | B2 * | 2/2011 | Rotharmel | 42/75.03 |
| 8,156,854 | B2 * | 4/2012 | Brown | 89/1.4 |
| 8,220,194 | B2 * | 7/2012 | Crow | 42/75.02 |
| 8,230,633 | B1 * | 7/2012 | Sisk | 42/75.01 |
| 2009/0313875 | A1 * | 12/2009 | Hines | 42/75.03 |
| 2011/0185618 | A1 * | 8/2011 | Jamison et al. | 42/75.03 |

FOREIGN PATENT DOCUMENTS

| | | |
|---|---|---|
| DE | 8409468 U1 | 7/1984 |
| DE | 9409365 U1 | 9/1994 |
| DE | 4337495 A1 | 5/1995 |

* cited by examiner

*Primary Examiner* — Bret Hayes
*Assistant Examiner* — Joshua Freeman
(74) *Attorney, Agent, or Firm* — Fleit Gibbons Gutman Bongini & Bianco PL; Martin Fleit; Paul D. Bianco

(57) ABSTRACT

The present invention relates to a mechanism for bedding a receiver frame (3) and/or a barrel (1) in a stock (2) of a firearm, the mechanism having a bearing component (8) which can be attached to the stock (2) and which, on its upper surface, has a bearing surface (10,11) for bearing the receiver frame (3) and/or the barrel (1). To ensure permanent and reproducibly accurate positioning, the lower surface of the bearing component (8) comprises a guide profile (9) for seating the bearing component (8) free from play in the stock (2).

11 Claims, 2 Drawing Sheets

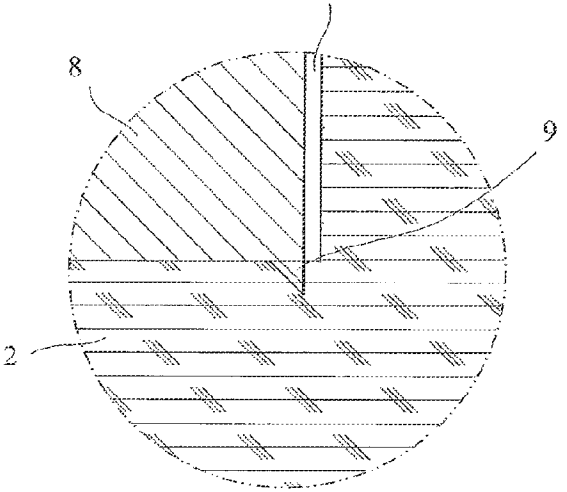
Fig. 3
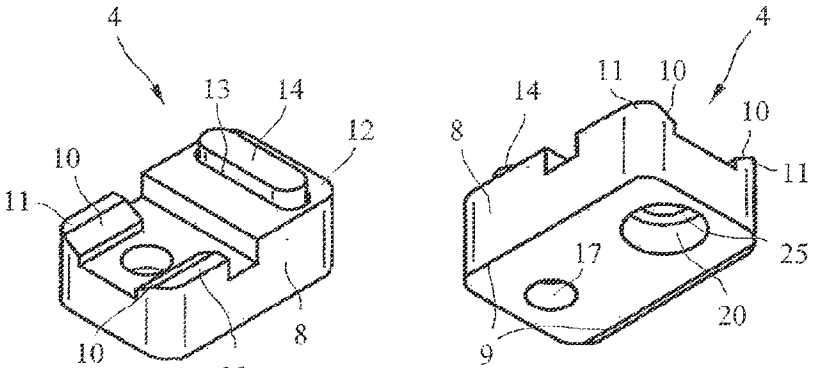
Fig. 4
Fig. 5
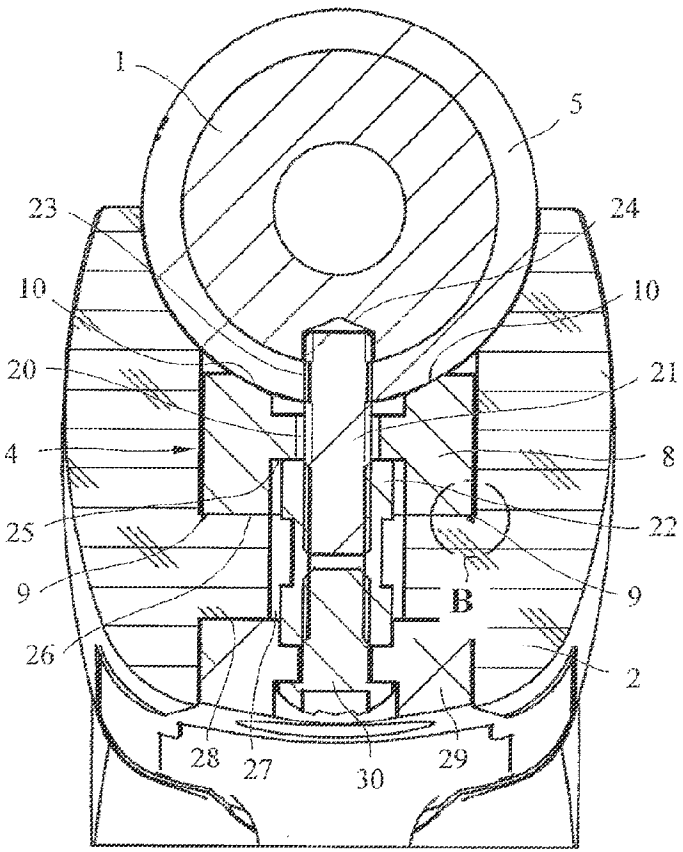
Fig. 2

MECHANISM FOR BEDDING A RECEIVER FRAME AND/OR A BARREL IN A STOCK OF A FIREARM

FIELD OF THE INVENTION

The present invention relates to a mechanism for bedding a receiver frame and/or a barrel in a stock of a firearm. In addition, the present invention also relates to a firearm comprising such a mechanism.

BACKGROUND OF THE INVENTION

In prior-art system beddings, a bearing component with bearing surfaces is inserted into a complementary recess on the stock where it is bolted or glued to the stock. In cases in which connection is implemented purely with bolts, however, a potential problem is that the connection between the stock and the bearing component may loosen, which can lead to a mutual displacement between the bearing component and the stock. If the bearing component is rigidly glued to the barrel, on the other hand, the bearing component can no longer be readily removed.

DE 84 09 468 U1 describes a mechanism for bedding a barrel in a stock of a rifle. The mechanism has a bearing component which, on its upper surface, has a support surface for receiving the barrel and a guide profile for seating the bearing component free from play in the stock on the lower surface. The guide profile has the shape of a wedge-shaped comb, the wedge surfaces of which rest free from play against the corresponding wedge surfaces of a wedge-shaped groove in an abutment made of steel.

SUMMARY OF THE INVENTION

The problem to be solved by one embodiment of the invention is to make available a mechanism for bedding a receiver frame and/or a barrel in a stock of a firearm, as well as a firearm comprising such a mechanism, in which the bearing component can be readily removed, yet allows permanent and reproducibly accurate positioning between the bearing component and the stock.

Beneficial improvements and useful advanced embodiments of the present invention are also set forth herein.

The mechanism disclosed by the present invention has a guide profile that is formed by downwardly projecting rib-like guide members which are designed such that they can be forced into the stock. During mounting, the guide profile engages in the stock which is made, e.g., of wood or plastic, and thus ensures an interlocking connection. Thus, lateral spread can be prevented and optimum system bedding and barrel fixation to ensure stress-free mounting in the stock can be achieved. An additional advantage of the mechanism disclosed by the present invention is that it is possible to mount a different receiver frame or barrel on the stock without additional fitting expenditures.

During mounting of the bearing component, the rib-like guide members that are disposed, e.g., along the edge of the bearing component are forced into the stock and ensure lateral guidance free from play. Because of the interlocking engagement of the rib-like guide members in the stock, it is possible to connect the stock to the receiver frame in such a manner that no displacement can occur and that reproducible accuracy is ensured for an accurate fixation of the barrel, without time- and cost-consuming preliminary preparative work on the stock.

In another preferred embodiment of the present invention, the rib-like guide members have a wedge-shaped cross section. Because of this special wedge shape, the rib-like guide members are forced into the stock, which can be made, e.g., of wood or of plastic, which has the effect of creating an interlocking connection that is free from play.

To support a hollow cylindrical front end of the receiver, the bearing surface can have the form of a prism-shaped support surface with oppositely slanted inside bearing surfaces on two rib-like bearing members that are disposed at a distance from each other. The bearing surface can also have the shape of a half shell or the like. If the front end of the receiver is not cylindrical, the bearing surface can also have a shape that conforms to the outer contour of the end of the receiver frame or of another part of the receiver frame.

Disposed on the bearing component, next to the bearing surface, is an abutment section with an abutment element for transmitting the forces of the recoil that act on barrel to the shaft when the shot is fired. The abutment element can be an adjusting spring that is disposed in the bearing component so as to engage in a transverse slot on the lower surface of the barrel or receiver frame.

BRIEF DESCRIPTION OF THE DRAWINGS

Other distinctive features and advantages of the present invention follow from the subsequent description of a preferred practical example that is based on the drawing. As can be seen:

FIG. 2 shows a cross section along line A-A seen in FIG. 1;

FIG. 3 shows an enlarged detailed view of area B seen in FIG. 2;

FIG. 4 shows a perspective view of the mechanism for bedding the receiver frame as seen from above; and FIG. 5 shows a perspective view of the mechanism for bedding the receiver frame as seen from below.

DETAILED DESCRIPTION OF THE INVENTION

Figure 1:
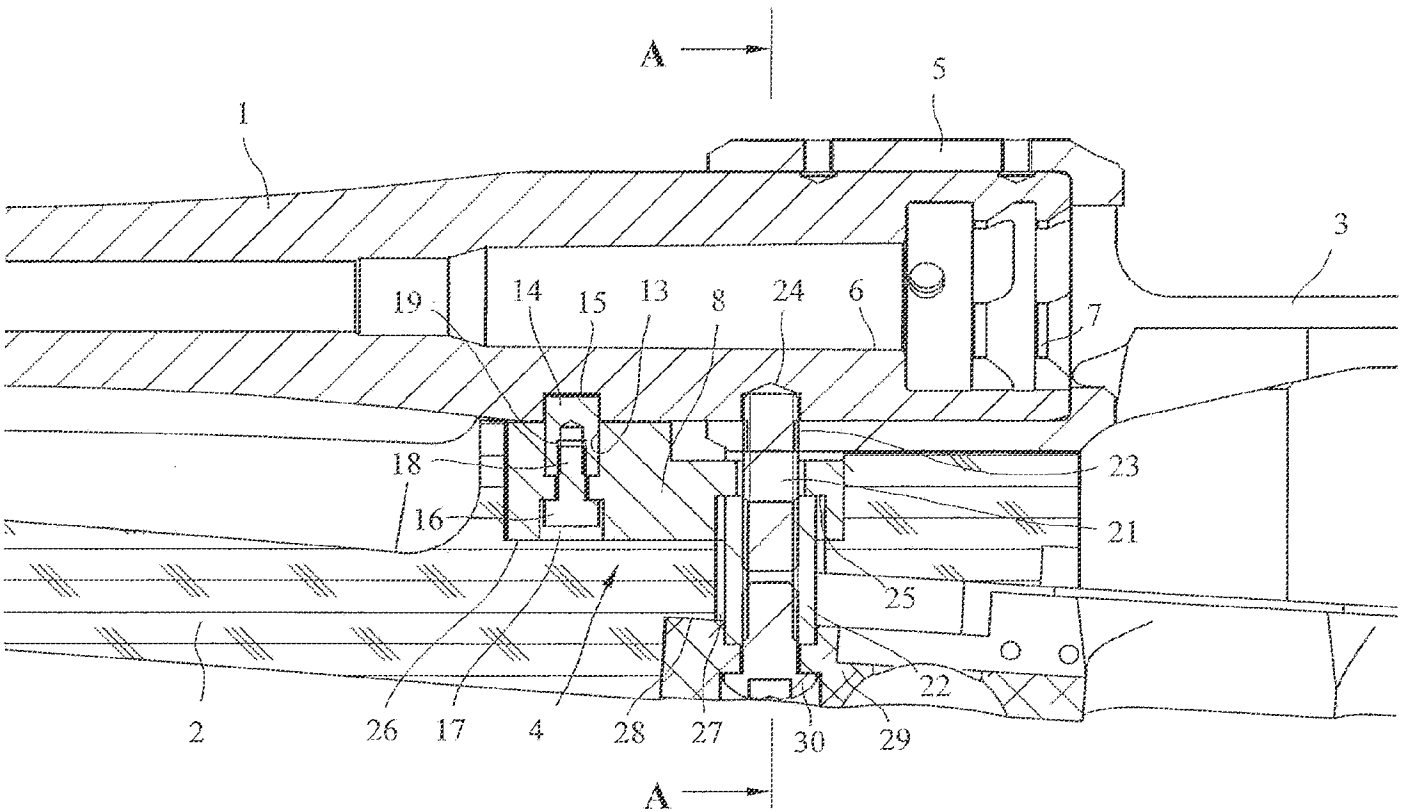
FIG. 1 shows a longitudinal sectional view of a part of a repeating rifle with a barrel, a stock, a receiver frame or system and a mechanism for bedding the receiver frame in the stock.

FIG. 1 shows a portion of a repeating rifle with a barrel 1, a stock 2, a system or receiver frame 3 and a mechanism 4 for bedding the system or receiver frame 3 in the stock 2. The system or receiver frame 3, here designed as a chamber sleeve, comprises a front end of the receiver 5 in which the back end of the barrel 1 comprising a cartridge chamber 6 and locking elements 7 is disposed.

The mechanism 4 for bedding the receiver frame 3 in the stock 2, which mechanism is as separately shown in FIGS. 4 and 5, has an essentially cubic bearing component 8 which, on its lower surface, has rib-like guide members 9 that can be forced into the stock 2 so as to ensure that the bearing component 8 is seated free from play in the stock 2. Because of the rib-like guide members 9 which engage in the stock 2 so as to interlock with said stock, a guide profile for lateral guidance is created on the lower surface of the bearing component 8. As the embodiment shown in FIG. 2 indicates, two parallel rib-like guide members 9 are disposed along the edges of the bearing component 8. FIG. 3 indicates that the rib-like guide members 9 have a wedge-shaped cross section. Because of this special wedge shape, during mounting (which will be discussed in greater detail below), the rib-like guide members are forced into the stock 2 which is, e.g., made of wood or plastic, which leads to an interlocking connection between the bearing component 8 and the stock 2 that prevents lateral movement.

As FIGS. 4 and 5 indicate, the upper surface of the bearing component 8 has a posterior bearing surface for bearing the hollow cylindrical front end of the receiver 5. In the embodiment shown, the bearing surface for bearing the front end of the receiver 5 is designed in the form of a prism-shaped bearing with two oppositely slanted inner bearing surfaces 10 on two rib-like bearing members 11 that are disposed at a distance from each other. It is, however, also possible for the bearing surface to have the shape of a half shell or the like. If the front end of the receiver is not cylindrical, the bearing surface can also have a shape that conforms to the outer contour of the front end of the receiver.

The upper surface of the bearing component 8 furthermore comprises an anterior abutment section 12 with an adjusting spring groove 13 that runs at right angles relative to the longitudinal axis of the gun. An upwardly projecting adjusting spring 14 is disposed in the adjusting spring groove 13 so as to be able to engage in a transverse slot 15 on the lower surface of the barrel 1 as shown in FIG. 1. The posterior bearing surface with the slanted bearing surfaces 11 is designed to ensure that when the hollow cylindrical front end of the receiver 5 rests on the bearing surfaces 10, the front end of the receiver 5 which is disposed on the barrel 1 does not rest against the anterior abutment section 12. Only the adjusting spring 14 which is disposed in the anterior abutment section 12 engages in the lower transverse slot 15 of the barrel 1 so as to transmit the recoil forces via the adjusting spring 14 and the bearing component 8 to the stock 2.

As FIG. 1 indicates, the adjusting spring 14 is held in place by a screw 16 which is disposed in a countersunk hole 17 that runs from the lower surface of the bearing component 8 to the adjusting spring groove 13, with the threaded shaft 18 of said screw engaging in a complementary tapped hole 19 on the lower surface of the adjusting spring 14. Between the two rib-like bearing elements 11, an additional through-hole 20, which again has the form of a countersunk hole, for a threaded bolt 21 and a threaded sleeve 22 is disposed so as to connect the bearing component 8 to the front end of the receiver 5. The upper portion of the threaded bolt 21 is screwed into a threaded hole in the lower surface of the front end of the receiver 5, and the upper end of the bolt engages in a cutaway section 24 of the stock 2. The upper frontal area of the threaded sleeve 22 rests against an inside annular surface 25 of the through-hole 20, which has the form of a countersunk hole. The threaded bolt 21 and the threaded sleeve 22 serve to screw the front end of the receiver 5 to the bearing component 8.

The bearing component 8 is inserted into a complementary recess 26 of the stock 2, and the threaded sleeve 22, which also serves as a spacer sleeve, engages in a hole 27 in the stock. On the lower end of the hole 27, a cutaway section 28 for receiving the front portion of a magazine frame 29 is disposed in the stock 2. Screwed into the lower end of the threaded sleeve 22 is a screw 30 by means of which the magazine frame 29 can be secured in the cutaway section 28 and tightened to the lower surface of the stock 2. In addition, as the screw 30 is being tightened, the screw 30 and the threaded sleeve 22, which also serves as a spacer sleeve, force the bearing component 8 into the recess 26 and press it against the upper surface of the stock 2, with the result that the rib-like guide members 9 are also forced into the stock 2 so as to create an interlocking connection. The interlocking engagement of the rib-like guide members 9 in the stock 2 leads to the desired lateral guidance.

The invention is not limited to the practical example described above. Thus, for example, it would also be possible to bed not only the front end of the receiver of a receiver frame which here is designed as a chamber sleeve, but also the barrel, or both, on the bearing component that has the guide profile disposed on it.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

What is claimed is:

1. A mechanism for bedding a receiver frame and/or a barrel in a stock of a firearm, the mechanism comprising:

a bearing component which can be attached to the stock and which has a bearing surface configured to bear the receiver frame and/or the barrel on an upper surface when the bearing component is connected to the firearm, and a guide profile for seating the bearing component free from play in the stock on a lower surface, wherein the guide profile includes at least one downwardly projecting wedge shaped guide member configured to project into material of the stock when the bearing component is connected to the stock.

2. The mechanism of claim 1, wherein the wedge shaped guide member pierces the stock when the bearing component is threadably connected to a receiver of the firearm.

3. The mechanism of claim 1, wherein the rib-like guide members are disposed along the edge of the bearing component.

4. The mechanism as in claim 1, wherein the bearing surface is a shell-shaped or prism-shaped support surface with oppositely slanted inside bearing surfaces on two rib-like bearing members, which are disposed at a distance from each other, for bearing a hollow cylindrical front end of the receiver of the receiver frame.

5. The mechanism of claim 1, wherein the bearing component comprises an abutment section with an abutment element for transmitting the recoil forces that act upon the barrel to the stock.

6. The mechanism of claim 5, wherein the abutment element is an adjusting spring disposed in an adjusting spring groove of the bearing component for engaging in a transverse slot on the lower surface of the barrel or of the receiver frame.

7. The mechanism of claim 1, wherein the bearing component is connected to the receiver frame via a threaded bolt that is secured inside the receiver frame and a threaded sleeve that rests against the bearing component.

8. The mechanism of claim 1, wherein the bearing component is connected to the stock via a screw that is screwed into the threaded sleeve and spring braced relative to the stock.

9. A firearm having a mechanism for bedding a receiver frame and/or a barrel in a stock, wherein the mechanism is constructed as in claim 1.

10. A mechanism for bedding a receiver frame and/or a barrel in a stock of a firearm, the mechanism comprising:

a bearing component, separable from the receiver and the stock, including a bearing surface shaped to matingly conform to one of the receiver frame and barrel when the bearing component is connected to the one of receiver frame and barrel, and a guide surface for seating the bearing component in the stock, the guide surface positioned on an opposite end of the bearing component with respect to the bearing surface, the guide surface including at least one edge surface projecting from the guide surface and configured to pierce the stock when the bearing component is threadably connected to the stock.

11. The mechanism of claim 10, the bearing component further including a spring configured to bear against the barrel.

* * * * *